United States Patent [19]

Rohner

[11] 4,240,500

[45] Dec. 23, 1980

[54] HEAT EXCHANGE APPARATUS

[75] Inventor: Peter Rohner, Isernhagen, Fed. Rep. of Germany

[73] Assignee: Kabel- und Metallwerke Gutehoffnungshuette AG, Fed. Rep. of Germany

[21] Appl. No.: 64,055

[22] Filed: Aug. 6, 1979

[30] Foreign Application Priority Data

Aug. 7, 1978 [DE] Fed. Rep. of Germany ..... 2834593

[51] Int. Cl.[3] ..... F28D 15/00

[52] U.S. Cl. ..... 165/105; 165/148

[58] Field of Search ..... 165/105

[56] References Cited

U.S. PATENT DOCUMENTS

| | | | |
|---|---|---|---|
| 2,089,540 | 8/1937 | Dallenbach | 165/105 X |
| 3,604,504 | 9/1971 | Kessler, Jr. et al. | 165/105 |

FOREIGN PATENT DOCUMENTS

| | | | |
|---|---|---|---|
| 2519803 | 11/1976 | Fed. Rep. of Germany | 165/105 |
| 602744 | 3/1926 | France | 165/105 |

*Primary Examiner*—Albert W. Davis

*Attorney, Agent, or Firm*—James C. Jangarathis

[57] ABSTRACT

A heat exchange apparatus is disclosed comprising a heat transfer conduit wherein a heat transfer fluid flows in a corrugated sealed evacuated tube between hot and cold zones with the fluid being evaporated in the hot zone and condensed in the cold zone, said tube being wound to provide a plurality of windings, with a first portion of each winding being in the hot zone and a second portion of each winding being in the cold zone. The heat transfer conduit so wound is axially positioned within a tubular container comprised of a metal of high heat transfer conductivity and having a polygonal cross section. Each first portion of such windings is attached to an interior surface of the tubular container by means of a connector member also of a metal of high heat transfer conductivity, thus providing an efficient heat conductance path from the outside surface of the tubular container to the inside surface of the plurality of windings in the hot zone. The outside surface configurations of the corrugated, wound evacuated tube in combination with the interior straight surfaces of the polygonal tubular container provide a high turbulence circumstance for the efficient transfer of heat for example between a heated liquid passing about the outside surfaces of the tubular container and a cooling gas passed axially through the interior of the tubular container.

10 Claims, 6 Drawing Figures

HEAT EXCHANGE APPARATUS

The invention is directed to an apparatus for heat exchange which comprises a heat transfer conduit positioned within and conductively connected to a tubular container having a polygonal cross section.

For heat exchanging between two different mediums there have been provided tubular structures wherein one medium is passed within the tube and the other medium is passed outside the tube. When a heat exchange is to be provided between a liquid and a gas medium, particular surface conditions are required in order to compensate for the different heat transfer characteristics between the liquid and the surface of the tube which it engages, and the heat transfer characteristics between the surface of the tube which engages the gaseous medium. In prior art devices the surface engaging the gaseous medium of the tube have often been provided with fins to increase the effected surface areas for minimizing the differences of such characteristics of liquid to solid, and solid to gaseous interfaces. Such compensating arrangements, however, have provided less than satisfactory technical solutions.

It is an object of the present invention to provide heat exchanger apparatus which is capable of efficient heat exchange between two different mediums, for example, between a liquid and a gas. In accordance with the invention at least one elongated heat transfer conduit is wound in a helical configuration and mounted upon the inner wall of a polygonal tubular container by a connector means comprised of a material of good heat conductivity. The heat transfer conduit comprises a corrugated, sealed tube container filled with a suitable heat transfer fluid which evaporates at a location within a high temperature (hot zone) and condenses at a location with a lower temperature (cold zone).

An essential advantage of the instant invention is that the sealed tube of the heat transfer conduit is corrugated to provide flexibility so that such tube may be wound in a helical configuration for providing a plurality of windings, a portion of each of which comes within a hot zone, and a portion of which comes within a cold zone; as well as increasing drastically the outside surface area of the sealed tube. The fact that the sealed tube is corrugated, wound in a helical configuration, and located within a polygonal tubular container provides the necessary medium turbulence within the tubular container for efficient heat transfer between a gaseous medium which is passed within the tubular container and the solid outside surface of the sealed tube. The plurality of windings resulting from helical configuration of the sealed tube provides a plurality of instances wherein the tube passes through the hot and cold zones, thereby acting in a manner tantamount to a plurality of heating tubes as distinguished from a single heating tube.

A particularly favorable heat transfer efficiency is further enhanced when the multiplicity of individual windings of the sealed tube are coupled with respect to each other with regard to heat transfer in the areas of the hot zone by a common connector member defining the connecting means which provides efficient heat transfer contact between the portions of the windings in the hot zones and inner surface of the polygonal tubular container.

In accordance with the present invention it has been found advantageous that the tubular container have a polygonal cross section, preferably hexagonal. The corrugated sealed tube may have a circular cross section, elliptical cross section or other cross section of uniform character along its longitudinal axis.

Further, in accordance with the instant invention, a plurality of heat transfer conduits may be mounted on various of the inside surface of the tubular container, in a manner to provide spacial interengagement (i.e., overlapping in the cross sectional view), spacially separated with respect to each other. The cross sectional configurations of volumes within the wound helical configured heat transfer conduits may have various geometrical configurations; e.g., circular, triangular, etc.

In accordance with the teachings of this invention, a plurality of heat exchanger apparatus each comprising a polygonal container with heat transfer conduits positioned therein with associated connecting means, may be used to form an array of heat transfer apparatus, each spacially separated from the other in parallel regimentation to form a heat exchanger field which may, for example, be utilized for cooling water from a power plant. In such instance, the heated water would be passed through the intermediary spaces or passages between the various tubular containers with improved turbulence because of the corners presented by the polygonal cross sections, and cooling air is passed through the interior volumes of each of the tubular containers engaging the corrugated outer surfaces of the heat transfer conduits under high turbulence condition. In such an array embodiment the hexagonal configuration of the cross sections of the tubular containers is especially advantageous since the laterally flowing water to be cooled is efficiently deflected for the creation of a turbulence condition between the uniformly spaced array of tubular containers.

The invention will be further described with respect to the accompanying drawings wherein.

The invention will now be described in conjunction with the drawings 1–6.

Figure 1:
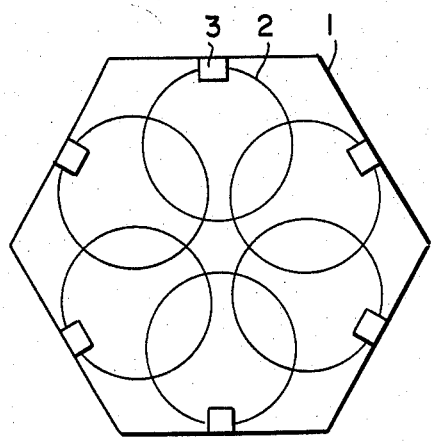
FIG. 1 is a simplified top plane view of an embodiment of the heat transfer apparatus of the present invention wherein the polygonal tubular container has a hexagonal cross section and within which are positioned a plurality of heat transfer conduits each helically wound about a spacial volume having a circular cross section.
Figure 4:
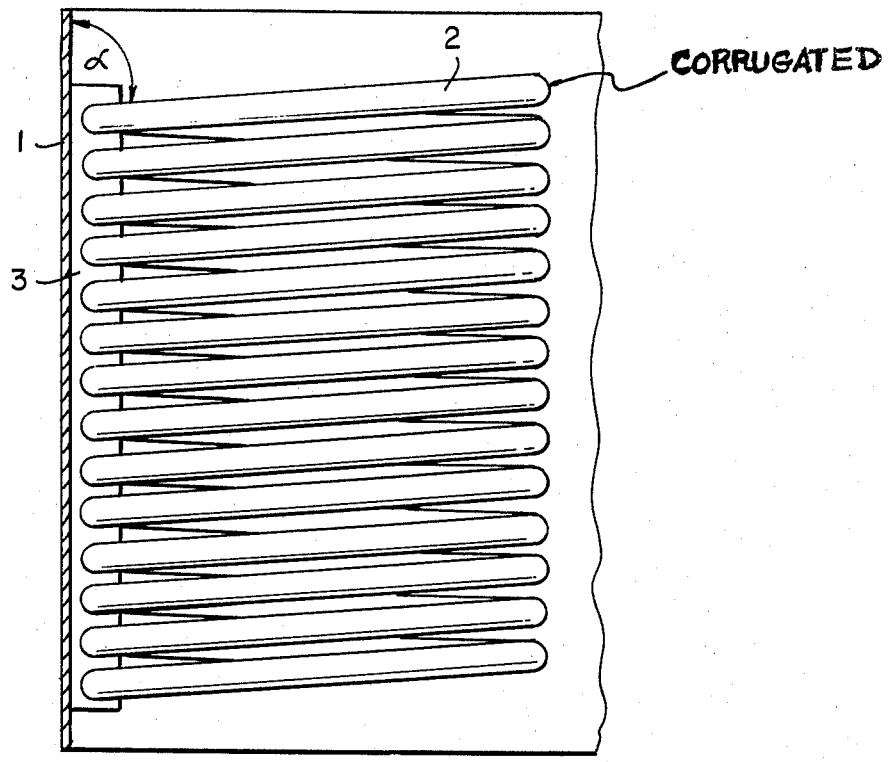
FIG. 4 is a partial elevation view illustrating the manner in which the tubular container, heat transfer conduit and connector means are structurally arranged in accordance with the principles of the instant invention.

The heat exchange apparatus 10 illustrated in FIG. 1 comprises a plurality of heat transfer conduits 2 of the aforesaid type having corrugated surfaces for increased flexibility, and increased exterior surface areas for greater surface contact between the conduits 2 and the medium that impinges thereon. The heat transfer conduits 2 are mounted by a connector member 3 upon the interior surface of a tubular container 1 having a hexagonal cross section. The tubular container 1 is comprised of a metal of good heat conductivity, for example aluminum or copper. The individual windings of the helically wound heat transfer conduits 2 are spaced apart from each other (as illustrated in FIG. 4) by the connector member 3 which is also formed of a material having good heat conductivity, such as copper. The connector member 3 is arranged to have good heat conducting contact with the individual windings of the heat transfer conduit 2, for example, by having recesses therein (not shown) that engage a major arc of the exterior surfaces of the heat transfer conduit 2, as well as with the inner wall of the tubular container 1, for example, by means of a soldered connection.

Figure 2:
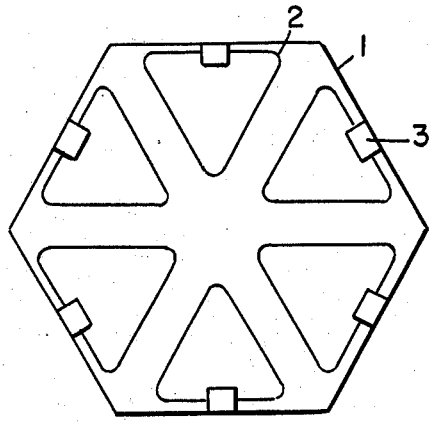
FIG. 2 is a simplified top plane view of an embodiment of the heat transfer apparatus of the present invention, differing from that illustrated in FIG. 1 in that the heat transfer conduits are helically wound about a spacial volume having a triangular cross section.

The embodiment of the instant invention depicted in FIG. 2, illustrates the employment of heat transfer conduits 2, wound in a helical manner about triangular shaped volumn which result in a cross sectional configuration wherein the plurality of heat transfer conduits 2 are efficiently placed within the volume of the tubular container 1 without a cross section overlap as is present in the arrangement illustrated in FIG. 1.

Figure 3:
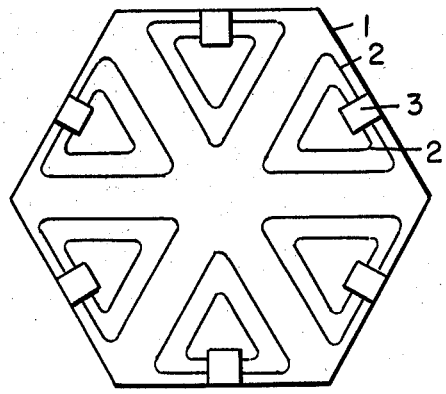
FIG. 3 is a simplified top plane view of an embodiment of the heat transfer apparatus of the present invention, differing from that illustrated in FIG. 2 in that an additional heat transfer conduit is provided helically wound about a spacial volume having a triangular cross section and being positioned within the larger heat transfer conduit illustrated in FIG. 2.

FIG. 3 provides a further alternative wherein two heat transfer conduits 2 are coupled to one of the inside walls of the tubular container 1 by a single connector member 3. As seen from FIG. 3, a bar shaped connector member 3 is soldered to the interior wall of the tubular container 1 and extends about the individual windings of the heat transfer conduits 2 in those areas of such conduits that define the hot zones.

With particular reference to FIG. 4, when heat is applied to the outer surface of tubular container 1, upon for example the impingement thereon by a liquid medium of high temperature, heat is transmitted through the solid wall of such tubular container 1, through the connector member 3, to the surfaces of the engaged portions of the windings of the heat transfer conduit 2, which results in a heating of the volume within such windings in the immediate vicinity of the connector member 3. This results in a hot zone within which the liquid medium is heated, resulting in a vapor of such medium transversing the interior volume of the winding of the heat transfer conduit 2 toward cold zones at the opposite or right hand portions of such windings as illustrated in FIG. 4. As condensation occurs at the cold zones, the heat of condensation is released heating the metallic inner surfaces of the heat transfer conduit 2 which results in the heating of the exterior corrugated surface of the conduit 2. The passage of a gaseous medium, for example, cold air, through the volume surrounding the heat transfer conduit 2 within the tubular container 1, causes a high turbulence condition in the vicinity of the outside corrugated surface of the heat transfer conduit 2, and thus a maximum heat transfer between such outer surface and the cold air which results in an increase in temperature of such media as it rises and emerges from the top portion of the tubular container 1. In the embodiment depicted in FIG. 4, the windings of the heat transfer conduit 2 are arranged to form an acute angle $\alpha$ with the surface of the tubular container to which the associated heat transfer conduit 2 is coupled. Consequently the condensate within the heat transfer conduit 2 is assisted by gravitational forces in its flow from the cold zones to the heating zones.

Figure 5:
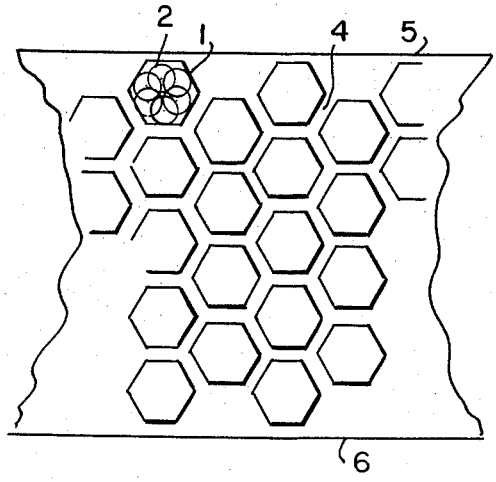
FIG. 5 is a simplified top plane view of a further embodiment of the present invention whereby a plurality of heat transfer apparatus of the type illustrated in FIG. 1 are arranged in an array to provide a heat exchange field.
Figure 6:
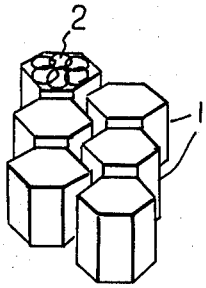
FIG. 6 is a simplified isometric view of the array of heat exchange apparatus illustrated in FIG. 5.

A further embodiment of the present invention is depicted in FIGS. 5 and 6 wherein a plurality of heat exchange apparatus of the type depicted in FIGS. 1–4 may be employed. FIGS. 5 and 6 illustrate a plurality of heat exchange apparatus each comprising a hexagonal tubular container 1 arranged in parallel with respect to each other and spacially separated in a uniform array so as to define passages through which, for example, water to be cooled may flow. The intermediary spaces between the tubular containers 1 may be sealed with suitable horizontal barriers (not shown) whereby the cross section of the flow of the water to be cooled from, for example, left to right, as illustrated in FIG. 5, is limited between two horizontal surfaces. Further, as illustrated in FIG. 5, there may be provided side walls 5 and 6 for limiting the cross section to specified side limits.

Numerous modifications and variations of the present invention are possible in light of the above teachings and, therefore, within the scope of the appended claims the invention may be practiced otherwise than as particularly described.

I claim:

1. Heat exchange apparatus comprising at least one sealed evacuated tube wherein a heat transfer fluid flows between hot and cold zones with the fluid being evaporated in the hot zone and condensed in the cold zone, the improvement comprising:

said tube being corrugated transverse to its longitudinal axis for increased surface area, and wound to provide a plurality of windings, a first portion of each winding being in the hot zone and a second portion of each winding being in the cold zone; said apparatus further comprising:

tubular container comprised of a material of high heat conductance and formed to have a polygonal cross section within which said wound tube is axially positioned; and connector means comprised of a material of high heat conductance and positioned within said tubular container for attaching first portions of said plurality of windings to an interior surface of said tubular container, so as to provide a high heat conductance path from the outside surface of said tubular container to the inside surface portions of said plurality of windings in the hot zone.

2. The apparatus of claim 1 wherein said connector means couples each of the individual windings of said plurality of windings to each other in the hot zone.

3. The apparatus of claim 1 comprising:

a plurality of said sealed evacuated tubes each axially positioned within said tubular container; and a plurality of said connector means positioned with said tubular container for attaching first portions of the windings of each of said sealed evacuated tubes to an interior surface of said tubular container, so as to provide a high heat conductance path from the outside surfaces of said tubular container to the inside surface portions of said windings of each of said sealed evacuated tubes.

4. The apparatus of claim 3 wherein at least two of said plurality of sealed evacuated tubes are attached by a common one of said connector means to a single interior surface of said tubular container.

5. The apparatus of claim 3 wherein each of said plurality of sealed evacuated tubes are helically wound to form a tubular configuration having a circular cross section.

6. The apparatus of claim 3 wherein each of said plurality of sealed evacuated tubes are helically wound to form a tubular configuration having a triangular cross section.

7. The apparatus of claim 5 wherein at least one of said plurality of sealed evacuated tubes is positioned axially about another of said plurality of tubes, and connected by a common one of said connector means to a single interior surface of said tubular container.

8. The apparatus of claim 6 wherein at least one of said plurality of sealed evacuated tubes is positioned axially about another of said plurality of tubes, and connected by a common one of said connector means to a single interior surface of said tubular container.

9. The apparatus of claim 1 further comprising a plurality of said tubular containers each including at least one of said tubes, and at least one of said connector means, to provide a high heat conductance path from the outside surfaces of each of said plurality of tubular containers to the inside surface portions of the windings of the tubes within said tubular containers in their respective hot zones, various of said plurality of tubular containers being spacially separated from the others in parallel regimentation to form an array having intermediary passages between exterior surfaces of said plurality of tubular containers through which a heated medium may be passed.

10. The apparatus of claim 9 wherein each of said tubular containers has a hexagonal cross section, and said plurality of tubular containers are arranged in parallel with respect to each other and spacially separated to provide a uniform array.

* * * * *